United States Patent [19]

Marczewski et al.

[11] 4,376,028

[45] Mar. 8, 1983

[54] DOME CAP FOR FUSED SALT ELECTROLYTIC CELL

[75] Inventors: Richard D. Marczewski, Amherst; Francis J. Ross, Niagara Falls, both of N.Y.

[73] Assignee: E. I. Du Pont de Nemours and Company, Wilmington, Del.

[21] Appl. No.: 240,417

[22] Filed: Mar. 4, 1981

[51] Int. Cl.[3] ..... C25C 7/00; C25C 3/02

[52] U.S. Cl. ..... 204/247; 204/279

[58] Field of Search ..... 204/279, 245, 68; 222/542, 562; 220/378

[56] References Cited

U.S. PATENT DOCUMENTS

| | | | |
|---|---|---|---|
| 801,199 | 10/1905 | Ashcroft | 204/68 |
| 1,283,830 | 11/1918 | Lorenz | 220/378 X |
| 1,501,756 | 7/1924 | Downs | 204/68 |
| 2,224,820 | 12/1940 | Hulse | 204/68 |
| 3,813,904 | 6/1974 | Wallskog | 220/378 X |
| 4,089,769 | 5/1978 | Jennings | 204/245 |

FOREIGN PATENT DOCUMENTS

| | | | |
|---|---|---|---|
| 982846 | 2/1965 | United Kingdom | 222/542 |

*Primary Examiner*—Donald R. Valentine

[57] ABSTRACT

A cap for the access port of the dome of a fused salt electrolytic cell comprising a circular cap body (1) having an outer flange (2) and a sealing surface (3) on its bottom, attached to the sealing surface an inner ring (4) concentric with the outer flange and with the flange defining a circular groove (5) within which the top of an access port (6) fits, within the groove a resilient refractory packing (7) that provides a seal between the top of the access port and the sealing surface.

3 Claims, 1 Drawing Figure

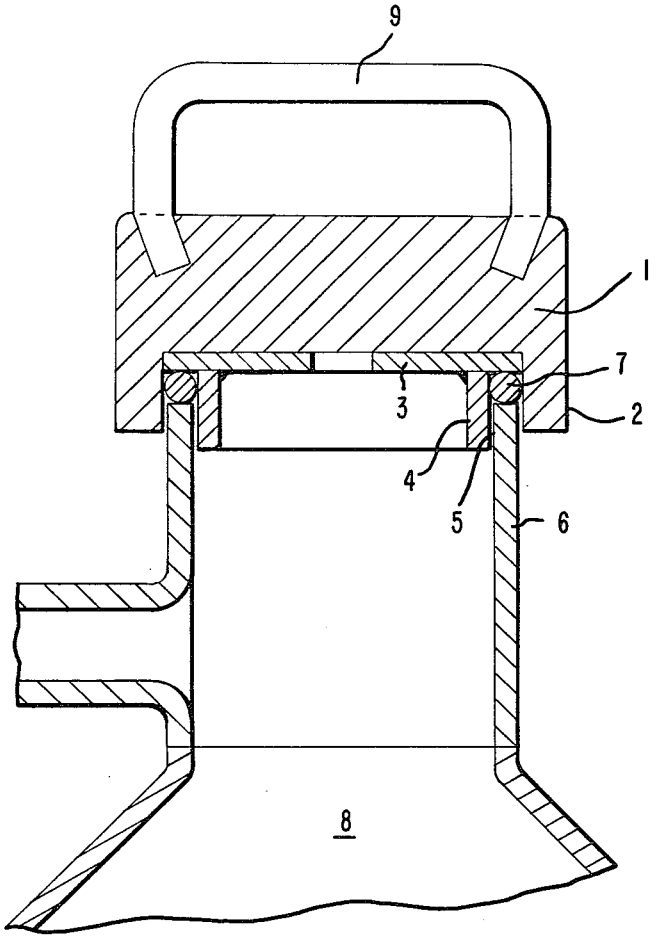
9
1
7
3
2
4
5
6
8

DOME CAP FOR FUSED SALT ELECTROLYTIC CELL

DESCRIPTION

1. Technical Field

This invention relates to an apparatus for sealing the surface of a cap for the access port of the dome of a fused salt electrolytic cell.

2. Background Art

Metallic sodium is ordinarily produced by electrolysis of a fused salt bath in a cell of the type described by Downs in his U.S. Pat. No. 1,501,756. In such a cell, metallic sodium forms at the cathode and rises through the electrolyte to a collector. From there it flows into a vertical riser pipe which conveys the sodium from the upper part of the cell to a receiver.

Sodium cell chlorine collection systems are equipped with a removable dome cap to allow periodic cleaning of solidified bath from piping directly above the cell. Dome caps also act as a pressure relief device should the piping inadvertently become plugged with bath.

Previous sodium cell dome caps relied on the weight of the cap plus contact of two polished nickel surfaces to prevent air inflow to the chlorine collection system or chlorine gas leakage from the dome. Frequent grinding of the nickel surfaces was necessary to control chlorine leakage. High chlorine gas concentrations often occurred above the sodium cells. Previous attempts to gasket dome caps have failed as high temperatures and corrosive conditions combined to destroy seals.

BRIEF DESCRIPTION OF THE DRAWING

The drawing is a vertical cross section of a dome cap for a fused salt electrolytic cell.

DISCLOSURE OF THE INVENTION

One will be better able to understand the apparatus of the invention by referring to the drawing.

In the drawing a cap for an access port in a narrow pipe is vertically mounted on the dome (8) of a fused salt electrolytic cell. The circular cap body (1) has an outer flange (2) and a sealing surface (3) on its bottom, attached to the sealing surface is an inner ring (4) concentric with the outer flange and with the flange defining a circular groove (5) within which the top of an access port (6) fits. Within the groove is a resilient, temperature resistant, inert packing (7) that provides a seal between the top of the access port and the sealing surface.

The circular cap body may be fitted with a handle (9).

The cap is preferably constructed of iron or steel.

The inner ring (4) may be of any material of construction which does not react with chlorine. Nickel is preferred. The ring serves to reduce salt particle buildup by shielding the packing from salt bath contamination thus extending the packing effectiveness and life. The replaceable packing resists thermal and chemical degradation while retaining sufficient resiliency to seal rough surfaces, even with periodic lifting of the cap.

A soft, finely woven material which can withstand chlorine and temperatures above 800° F. is most suitable and a refractory silica is a preferred material for the packing.

The invention effectively seals the dome cap against chlorine gas leakage while retaining pressure relief capability and providing access to the dome interior for cleaning solidified bath.

We claim:

1. An electrolytic cell for the production of sodium and chlorine from fused salts, the cell having a cylindrical dome for collection of chlorine, a circular access port at the top of the dome, and a removable, floating, mating cap for the port, the cap comprising (a) a circular body having a flange on its periphery and a sealing surface on the portion of the body which engages the lip of the port;

(b) attached to the circular body an inner ring, concentric with the outer flange, which, with the flange, defines a circular groove mated to the lip of the access port; and (c) within the groove, a resilient inert packing which provides a seal between the lip of the access port and the sealing surface.

2. The cell of claim 1 in which the inner ring in (b) is of nickel.

3. The cell of claim 1 in which the packing in (c) is of refractory silica.

* * * * *